United States Patent [19]

Coil et al.

[11] 4,190,447

[45] Feb. 26, 1980

[54] COVER SHEETS FOR INTEGRAL IMAGING RECEIVER ELEMENTS

[75] Inventors: Michael K. Coil, Fairport; Robert A. Sylvester, Hilton, both of N.Y.

[73] Assignee: Eastman Kodak Company, Rochester, N.Y.

[21] Appl. No.: 970,403

[22] Filed: Dec. 18, 1978

Related U.S. Application Data

[63] Continuation of Ser. No. 867,845, Jan. 9, 1978, abandoned, which is a continuation-in-part of Ser. No. 789,060, Apr. 20, 1977, abandoned.

[51] Int. Cl.[2] ..... G03C 5/54; G03C 1/40; G03C 1/76

[52] U.S. Cl. ..... 430/214; 430/223; 430/215

[58] Field of Search ..... 96/3, 29 D, 77, 76 R, 96/76 C, 111, 73

[56] References Cited

U.S. PATENT DOCUMENTS

| | | | |
|---|---|---|---|
| 2,983,606 | 5/1961 | Rogers | 96/29 D |
| 3,415,644 | 12/1968 | Land | 96/29 D |
| 3,490,911 | 1/1970 | Barness et al. | 96/111 |
| 3,586,503 | 6/1971 | Taylor | 96/29 D |
| 3,635,707 | 1/1972 | Cole | 96/29 D |
| 3,721,562 | 3/1973 | Land | 96/29 D |
| 3,836,365 | 9/1974 | Reid | 96/77 |
| 3,847,615 | 11/1974 | Yoshida et al. | 96/77 |
| 3,888,669 | 6/1975 | Cardone | 96/77 |
| 4,009,030 | 2/1977 | Abel | 96/77 |
| 4,056,394 | 11/1977 | Hannie | 96/77 |
| 4,061,496 | 12/1977 | Hannie et al. | 96/77 |

OTHER PUBLICATIONS

"Integral Film Unit . . . " Kunz et al., *Research Disclosure*, #13513, Jul. 1975, pp. 23–25.

"Photographic Processes and Products" *Research Disclosure*, #15162, Nov. 1976, pp. 75–87.

"Photographic Elements and Processes", Kestner et al., *Research Disclosure*, #15157, Nov. 1976, pp. 68–74.

*Primary Examiner*—Richard L. Schilling

*Attorney, Agent, or Firm*—J. Jeffrey Hawley

[57] ABSTRACT

A cover sheet for an integral imaging receiver element comprises a support, a neutralizing layer, at least one timing layer and an alkali permeable hydrophilic layer. The cover sheet may also contain a second alkali permeable layer coated over the alkali permeable hydrophilic layer to promote adhesion of the cover sheet to the other components of the film unit. The photographic film units containing the cover sheets are substantially free from dark spot imperfections and are resistant to delamination of the unit.

18 Claims, No Drawings

COVER SHEETS FOR INTEGRAL IMAGING RECEIVER ELEMENTS

This is a continuation of application Ser. No. 867,845, filed Jan. 9, 1978, which in turn was a continuation-in-part of Ser. No. 789,060, filed Apr. 20, 1977, both abandoned.

FIELD OF THE INVENTION

The present invention relates to cover sheets for image transfer film units. In particular, it relates to an improved cover sheet having a hydrophilic layer which has the effect of reducing physical imperfections possibly caused by bubble formation in the processing composition and delamination of the cover sheet from the integral imaging receiver.

BACKGROUND OF THE INVENTION

Image transfer processes are well known in the art. These processes generally employ a single processing solution to develop an exposed image record and to produce a viewable image record.

Various formats for color diffusion transfer assemblages are described in the prior art such as U.S. Pat. Nos. 2,543,181, 2,983,606, 3,362,819, 3,362,821, 3,592,645, 3,785,815, 3,415,644, 3,415,645, 3,415,646, 3,647,437, 3,635,707 and 3,756,815 and Canadian Pat. Nos. 928,559 and 674,082. In these formats, the image-receiving layer containing the photographic image for viewing can be separated from the photographic layers after processing or, in some embodiments, when a transparent support is employed on the viewing side of the assemblage, it can remain permanently attached and integral with the image-generating and ancillary layers present in the structure. The image is formed by color-providing substances, released from the image-generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image-generating layers begin to diffuse throughout the structure. At least a portion of the imagewise distribution of color-providing substances diffuse to the dye image-receiving layer to form an image of the original subject.

It is common in the art to provide the image generating layer on one element with a so-called cover sheet as another element. The image generating element and the cover sheet are then placed together to form a laminate either at the time of manufacture for integral film units or after the exposure of the image generating layer. After exposure, an alkaline processing composition can be discharged between the cover sheet and the image generating element.

The cover sheet for the image transfer film unit can have a wide variety of layers that serve various functions. One combination of layers that is commonly found in the cover sheet is an acid neutralizing layer in conjunction with a timing layer. The alkaline processing composition penetrates through the timing layer and alkali is depleted in the film unit by the acid in the neutralizing layer. Depletion of the alkali serves several functions, the most important of which is usually the immobilization of the dyes. The cover sheet can also have other layers such as subbing layers, light filter layers, curl control layers, friction reducing layers and the like depending on the particular format of the image transfer film unit.

The timing layer of the image transfer film unit serves to delay the release of acid from the neutralizing layer for a predetermined period. The timing layer may be an inert spacer layer in which case the delay results principally from the time required for the alkali to physically pass through the layer. Inert spacer timing layers, even when very thick, only provide for a short delay. Examples of inert spacer layers are layers of gelatine, poly(vinyl alcohol), carboxymethylcellulose, polyacrylamide, hydroxypropylcellulose and the like. Alternatively, the timing layer may be a barrier timing layer in which case the delay results not only because of the time required for physical permeation but principally because of the time required for chemical reaction. A barrier timing layer is initially substantially impermeable and time is required to allow the aqueous alkaline solution to react with the layer and increase its permeability. Usually the permeability increasing reaction that takes place is the hydrolysis or neutralization of the layer by the alkaline solution. Typically, therefore, a barrier timing layer comprises a substantially alkaline solution impermeable material which can be hydrolyzed or neutralized by the alkaline solution to a substantially alkaline solution permeable material. Examples of barrier timing layers include the timing layers described in Ser. No. 676,945 filed Apr. 14, 1976 by Hannie now U.S. Pat. No. 4,056,394; layers composed primarily of cellulose acetate having an acetate content of about 40 percent such as described in U.S. application Ser. No. 521,221 filed Nov. 5, 1974 by Abel now U.S. Pat. No. 4,009,030. Other barrier timing layers include polyvinyl acetate or mixtures thereof, copolymers of dimethoxymethylene such as described in German OLS No. 2,455,762 and the like.

In some image transfer processes, the image generating element also contains the image receiving layer. In these formats the image generating element can be described as an integral imaging receiver element. After imagewise exposure and during processing, the generated image diffuses to the image receiving layer. In some embodiments of this process the image may be formed by exposure of the image generating element through a transparent cover sheet. A hybrid type of image transfer process is described in U.S. Pat. No. 3,836,365. In this process both the image-generating element and the cover sheet have an image receiving layer. With one exposure, two images can be formed in the two image receiving layers. Unfortunately, the image formed in the integral-generating element is commercially unsatisfactory. Thus, the problem of obtaining satisfactory images in the image generating element and at the same time images which have good physical properties, has not been solved.

It is desirable, in order to provide for processing of the element in ambient room light conditions, that the viscous processing composition that is discharged between the transparent cover sheet and the integral imaging receiver be opaque so as to prevent the fogging of the integral imaging receiver during processing. It will be readily apparent that any discontinuities in the opaque processing composition will produce undesirable areas of maximum density in the final image due to the fogging of the image generating element through the discontinuity. The fogging may either be caused because of light exposing the integral imaging receiver or because the alkali can not be neutralized by the acid from the cover sheet in the area of the discontinuity. In the latter case the dark spot is caused by overdevelopment. Whatever the mechanism, the discontinuities in the processing composition produce what we refer to herein as dark spots.

Unfortunately, it has been found that when the viscous processing composition is discharged between the cover sheet and the integral imaging receiver, bubbles are frequently entrained. Generally, the bubbles that are entrained are small enough so as not to form a discontinuity in the processing composition. However, it has been found that a large number of these relatively small bubbles coalesce during the first few minutes after the processing composition is discharged. These bubbles can coalesce to a size which results in a discontinuity being formed in the processing composition. In the majority of film units, the picture area is defined by a black aperture mask placed between the cover sheet and image generating element. Coalesced bubbles have a tendency to collect at the edges of the aperture and the resultant dark spots have therefore been designated aperture border imperfections. A lesser number of coalesced bubbles may cause discontinuities in the processing composition and resultant dark spots within the aperture area. Further, it has been found that in some instances user handling of the film unit during these first critical minutes or structural stresses in the film unit can cause delamination of the cover sheet from the image generating element. This delamination can also cause discontinuities in the processing composition in the form of finger like projections from the edges of the film unit. In film units having a timing layer which is a barrier layer, bubble formation and delamination are particularly evident.

While the effect of bubble formation and delamination has been described with particular reference to a process wherein the integral imaging receiver can be fogged due to a discontinuity in the processing composition, it is readily apparent that any nonuniformity in the processing composition could be detrimental to the final image regardless of the format.

The prior art has not recognized that the small bubbles formed in the processing composition when it is discharged between the cover sheet and the image generating element may coalesce to form larger bubbles which may form discontinuities in the processing composition. The prior art also lacks a solution to the problem of delamination of the cover sheet from the image generating element during processing.

SUMMARY OF THE INVENTION

We have found that the above-described imperfections may be substantially eliminated in a format using an integral imaging receiver by providing a cover sheet having an alkali permeable hydrophilic layer which is substantially free of dye mordant. The alkali permeable hydrophilic layer is coated so as to be the layer of the cover sheet that is first exposed to the alkaline processing composition when the composition is discharged between the cover sheet and the image generating element. Alternatively, the alkali permeable hydrophilic layer may be separated from the surface of the cover sheet that is exposed to the alkaline processing composition by a layer or layers which are permeable to the alkali processing composition and are not barrier layers. The alkali permeable hydrophilic layer should be in a position on the cover sheet to absorb water from the alkaline processing composition immediately after it is discharged between the cover sheet and the image generating element.

While it is not completely understood why the hydrophilic layer in this position decreases the described imperfections, it is believed that by absorbing water from the processing composition into the hydrophilic layer, the viscosity of the composition rapidly increases after it is discharged. It is theorized that this rapid increase in viscosity shortly after discharge significantly retards the migration of the small bubbles that are formed in the alkaline processing composition thereby not allowing them to coalesce. It has further been theorized that increasing the viscosity of the alkaline processing composition, especially at the cover sheet surface, results in improved adhesivity of the cover sheet to the image generating element and masking material and improved cohesiveness of the processing composition. This improved adhesivity, in turn, decreases the tendency for delamination of the film unit. For these reasons, it is believed that the alkali permeable hydrophilic layer is particularly important in cover sheets where the timing layer is a barrier layer which initially retards the take-up of the processing composition by the cover sheet.

There is provided according to the present invention, a photographic film unit comprising:

(a) an integral imaging receiver element comprising a support having thereon at least one photosensitive silver halide emulsion layer having associated therewith a dye image providing material and a dye image receiving layer; and having adjacent to said integral imaging receiver element;

(b) a cover sheet comprising, in order, starting with the layer adjacent to said integral imaging receiver element, a barrier timing layer, a neutralizing layer for neutralizing an alkaline processing composition and a support;

(c) means for discharging an aqueous alkaline processing composition between said integral imaging receiver element and said cover sheet; the improvement comprising an alkali permeable hydrophilic layer which is substantially free of dye mordant coated over said barrier timing layer on said cover sheet so as to be between said barrier timing layer and said integral imaging receiver element.

In a number of embodiments, it is advantageous to affix various film unit components to the cover sheet. For example, it may be advantageous to affix so-called "spacer rails" to the edges of the cover sheet so as to more precisely define the space between the cover sheet and the image generating element into which the alkaline processing composition is discharged. Spacer rails are described, for example, in U.S. patent application Ser. No. 572,541 filed Apr. 28, 1975, now U.S. Pat. No. 4,042,395. We have found that the alkali permeable hydrophilic layer described above retains its effectiveness when overcoated with an alkali permeable layer, preferably an alkali permeable adhesion promoting layer. Thus in another aspect of the present invention there is provided a photographic film unit having a cover sheet, as described above, further comprising an alkali permeable adhesion promoting layer coated over the alkali permeable hydrophilic layer.

In particularly preferred embodiments of the present invention, there is provided a photographic film unit having a cover sheet as described above, wherein the alkali permeable hydrophilic layer is coated over the cover sheet described in "Timing Layers for Photographic Products" to Hannie and Ducharme, U.S. Ser. No. 676,947, filed Apr. 14, 1976, now U.S. Pat. No. 4,061,496. Thus an integral imaging receiver element is provided with a cover sheet comprising a support having coated thereon, in order, a neutralizing layer for neutralizing an alkaline processing composition; a layer comprising a polymer material which has an activation energy of penetration of the layer by an aqueous alkaline solution of less than 18 kcal/mole; a layer comprising a polymeric latex which has an activation energy of penetration of the layer by an aqueous alkaline solution of greater than 18 kcal/mole; and an alkali permeable hydrophilic layer.

DETAILED DESCRIPTION OF THE INVENTION

The coverage of the alkali permeable hydrophilic layer can vary over a wide range. The exact minimum amount will depend on factors such as the particular hydrophilic material chosen; the degree of hardening or crosslinking; the water content of the processing composition; the conditions of drying and whether other layers are coated over the hydrophilic material. In formats where the image is viewed through the cover sheet, the layer should be as thin as possible so as not to adversely affect image quality. The layer need only be coated at a coverage sufficient to absorb sufficient water to increase the viscosity of the processing composition after it is discharged between the integral imaging receiver element and the cover sheet. For a typical hydrophilic material, such as hardened gelatin, a range of coverage between 2 and 5.5 grams per square meter is useful, however, higher and lower coverages can be used. The preferred coverage of the hydrophilic layer is between three and four grams per square meter of cover sheet.

The material chosen for the alkali permeable hydrophilic layer should have a capacity to absorb water quickly from the processing composition. Experiments have shown that bubbles can begin to coalesce within about five seconds after the processing composition is discharged. By "alkali permeable" therefore, it is meant that the material not only be ultimately permeable to alkaline solution but should provide no initial barrier to permeability. Suitable alkali permeable hydrophilic materials include gelatin, poly(vinyl alcohol), poly(ethyl methacrylate-co-methacrylic acid), poly(methyl methacrylate-co-methacrylic acid), poly(methyl vinyl ether-co-maleic anhydride), casein, carboxymethylcellulose, hydroxyethylcellulose, cellulose acetate phthalate, grafted starch copolymers such as hydrolyzed copolymers of polyacrylonitrile grafted to starch such as described in U.S. Pat. Nos. 3,935,099 and 3,997,484 and the like. Mixtures of materials can also be used. Where the cover sheet is to be transparent, the hydrophilic layer must, of course, be transparent. All of the materials above form transparent layers.

A particularly preferred alkali permeable hydrophilic material is gelatin. Gelatin may be used alone, however, peeling of the edges of the cover sheet sometimes occurs. Hardening of the gelatin prevents this peeling and it is therefore preferred that the gelatin be hardened with about 0.5 to about 2.0, preferably about 1.0 weight percent of hardener. While a wide variety of hardeners can be used, vinyl sulfone hardeners are preferred.

The alkali permeable hydrophilic layer should be substantially free from dye mordant. Mordant in this layer has a serious adverse affect on the quality of the image that is formed in the dye receiving layer of the integral imaging receiver element. This is shown below in Example 3. Thus, the material chosen for this alkali permeable hydrophilic material should not hold dye to any appreciable extent nor should any dye mordanting materials be mixed with the alkali permeable hydrophilic material.

It is desirable to have the alkali permeable hydrophilic layer of the cover sheet immediately adjacent to the discharged processing composition. However, it has been found, and in fact is a preferred embodiment, that the hydrophilic layer can be removed from the processing composition by an alkali permeable layer. Like the hydrophilic layer itself, this layer should provide no initial barrier to permeability. The advantage in being able to overcoat the hydrophilic layer with another layer is that the outermost layer can now be an adhesion promoting layer. This facilitates the manufacture of the film unit. In a procedure for fabricating film units such as described in Tone et al U.S. Pat. No. 4,042,395, it is desirable to secure the cover sheet to other film unit components, for example, the so-called "spacer rails" using a thermosensitive adhesive. When thermosensitive adhesives are used to secure the spacer rail to the cover sheet, the adhesion promoting layer provides for a better bond to the cover sheet than does the hydrophilic layer. The adhesion promoting layer need not be made from a material which is itself an adhesive. Any alkali permeable material may be used which provides an improved bond between the thermosensitive adhesive and the hydrophilic colloid layer and may be a hydrophobic or hydrophilic material. The preferred alkali permeable adhesion promoting material is a non-hydrophilic material such as the substantially uncoalesced terpolymer poly(acrylonitrile-co-vinylidene chloride-co-acrylic acid) which has been coated and dried at relatively low temperature, i.e., between 20° and 93° C. and preferably between 20° C. and 55° C. for about 0.5 to 5 minutes and preferably about 2 minutes. Coverage for this layer can vary but is typically between 0.3 and 3.0 grams per square meter of cover sheet. A coverage of about 1 gram per square meter of cover sheet is preferred.

The alkali permeable hydrophilic layer is coated over a barrier timing layer. A preferred barrier timing layer for the practice of the present invention is described in copending U.S. application Ser. No. 676,945 filed Apr. 14, 1976 entitled "Timing Layer for Color Transfer Film Units" by Hannie, now U.S. Pat. No. 4,056,394, the disclosure of which is hereby incorporated by reference. Hannie describes a relatively temperature dependent timing layer which comprises a polymeric latex having an activation energy of penetration by aqueous alkaline solution of greater than 18 kcal/mole. A particularly preferred timing means is described in copending U.S. application Ser. No. 676,947 filed Apr. 14, 1976 entitled "Timing Layers for Photographic Products" by Hannie and Ducharme, now U.S. Pat. No. 4,061,496, the disclosure of which is hereby incorported by reference. Hannie and Ducharme describe timing means which comprises two adjacent barrier timing layers, one of which comprises a polymeric latex having an activation energy of penetration to aqueous alkaline solution of greater than 18 kcal/mole and the second a polymeric latex having an activation energy of penetration to aqueous alkaline solution of less than 18 kcal/mole.

The activation energy of penetration of polymeric layers by aqueous alkaline solutions can be determined by the following simple test.

A thymolphthalein dye or cresol red dye indicator is coated on a polyethylene terephthalate film support at 210 mg/m$^2$ with 6.6 gm/m$^2$ gelatin in the case of thymolphthalein or 2.2 gm/m$^2$ in the case of cresol red.

A processing composition comprising a pod which contains about 0.84 N potassium hydroxide and about 5% carboxymethylcellulose in water, along with other conventional developer ingredients, is spread between the element containing the indicator dye and a sample of a cover sheet by passing the "sandwich" between a pair of juxtaposed pressure rollers so that the developer layer thickness is 0.1 mm.

The cover sheet comprises a poly(ethylene terephthalate) support containing a first layer of a 30/70 (by weight) copolymer of poly(butyl acrylate-co-acrylic acid), a second layer of 50/50 (mole ratio) polymer of poly(styrene-co-maleic anhydride) at 2.2 g/m$^2$ and the outer layer being the polymer for which the activation energy is to be determined.

The time required to reduce the pH of a unit to pH 10 as measured by the color change of the thymolphthalein dye from blue to colorless or to pH 8 as measured by the change of the cresol red dye from red to yellow is measured at various temperatures within the range of 13° to 54° C. The time in seconds is plotted on a logarithmic scale against the reciprocal of the temperature expressed in °K. The activation energy in kcal/mole is determined from the slope of the straight line portion of the curve according to the formula:

$$-E_a \text{ (activation energy)} = 0.00458 \times \frac{\log Y_2/Y_1}{1/T_2 - 1/T_1}$$

where $T_2$ is the higher temperature and $T_1$ is the lower temperature and $Y_2$ is the time at $T_2$ and $Y_1$ is the time at $T_1$. The thickness of the acid layer and the polymer layer is not critical to the proper determination of activation energy.

A discussion of activation energy calculations can be found in *Kinetics and Mechanism,* 2d edition, N.Y., John Wiley and Sons, 1961, pp. 22–25.

A wide variety of materials are useful for the barrier timing layers herein. Examples of useful polymers having an activation energy of penetration of aqueous alkaline composition of less than 18 kcal/mole are mixtures of cellulose acetate and a maleic anhydride copolymer with 5 to 50% by weight of the mixture being said copolymer such as described in U.S. Ser. No. 521,221 by Abel filed Nov. 5, 1974, now U.S. Pat. No. 4,089,030. The maleic anhydride copolymer in these barrier timing layers should be employed in a concentration of about 2 to about 20% by weight, depending somewhat on the other comonomer. A 5–20% concentration has been found to be particularly effective. The thickness of the timing layer should be such to provide a coverage of about 1 to about 5 grams/m$^2$.

The cellulose acetate employed in the barrier timing layers will usually have acetyl contents of about 37–40% by weight, the 37% being substantially more permeable than the 40% acetyl. Mixed esters can also be employed such as cellulose acetate propionate, cellulose acetate butyrate, etc.

The maleic anhydride copolymer can be selected from a wide variety of materials so long as it is compatible with the cellulose acetate employed to provide a clear film. Particularly good results are obtained with poly(styrene-co-maleic anhydride), poly(ethylene-co-maleic anhydride) and poly(methyl vinyl ether-co-maleic anhydride).

A portion of the anhydride of the maleic anhydride copolymer used may also be hydrolyzed to the corresponding acid prior to use. For example, poly(styrene-co-maleic anhydride) was analyzed and found to contain 8 mole percent maleic anhydride, 7 mole percent monomethyl maleate, 26 mole percent maleic acid and 59 mole percent styrene. It is seen, therefore, that the mole percent of maleic anhydride derived component in the copolymer can vary over a wide range, with about 30% to about 50% generally providing good results.

Examples of other barrier timing layers containing polymers having an activation energy of less than 18 kcal/mole are polyvinyl acetate, cellulose acetate phthalate, partial acetals of polyvinyl alcohol, a polymer latex of butyl acrylate-diacetone acrylamide-styrene-methacrylic acid (60/30/4/6) as described in U.S. Pat. No. 3,785,815, mixtures of polyvinyl acetate and polyvinyl alcohol such as polyvinyl acetate latex in 78/22 ratio with polyvinyl alcohol, cellulose acetate ((40% acetate in 95/5 ratio with poly(styrene-co-maleic anhydride)) (50/50 mole ratio) as described in U.S. application Ser. No. 521,221 and the like.

These barrier timing layers may be used alone or in combination with a barrier timing layer comprising a polymer having an activation energy of penetration to aqueous alkaline solution of greater than 18 kcal/mole.

Preferred polymeric latexes having an activation energy of penetration to aqueous alkaline solution of greater than 18 kcal/mole are terpolymers of from about 5 to about 35 percent by weight of polymerized ethylenically unsaturated monomer from about 2 to about 10 by weight of polymerized ethylenically unsaturated carboxylic acid and from about 55 to about 85 percent by weight of polymerized vinylidene chloride.

Latex terpolymers having an activation energy to penetration by aqueous alkaline solution of greater than 18 kcal/mole include poly(methyl acrylate-co-itaconic acid-co-vinylidene chloride) and the like.

Any ethylenically unsaturated monomer which is different from the other monomers in the polymeric latex can be used to prepare the terpolymer including alkyl acrylates and methacrylates such as methyl acrylate, ethyl acrylate, propyl acrylate, butyl acrylate, butyl methacrylate and the like; vinyl esters, amides, nitriles, ketones, halides, ethers, olefins, diolefins and the like as exemplified by acrylonitrile, methacrylonitrile, styrene, alpha-methyl styrene, acrylamide, methacrylamide, vinyl chloride, methyl vinyl ketone, fumaric, maleic and itaconic esters, 2-chloroethylvinyl ether, dimethylaminoethyl methacrylate, 2-hydroxyethyl methacrylate, N-vinylsuccinamide, N-vinylphthalimide, N-vinylpyrrolidone, butadiene, ethylene and the like. Preferred monomers are methyl acrylate and acrylontrile.

Examples of ethylenically unsaturated carboxylic acids which can be included in the polymer include acrylic acid, methacrylic acid, itaconic acid, fumaric acid, maleic acid, their anhydrides and the like. The preferred carboxylic acids are acrylic acid and itaconic acid.

The latex polymers can be prepared by polymerizing the monomers in water. For example, a terpolymer comprising 15 weight percent acrylonitrile, 80 weight percent of vinylidene chloride and 5 weight percent of acrylic acid can be prepared by charging into a reactor 4.5 g of potassium persulfate dissolved in water, stirring, cooling to 20° C. and purging with nitrogen and adding 257 g of acrylonitrile, 1453 g of vinylidene chloride, 90 g of acrylic acid and 450 g of surfactant. To this is added a solution of 2.25 g of potassium peroxydisulfate or persulfate in water and the reaction is continued at 30° C. and 150 revolutions per minute stirring.

A wide variety of surfactants can be used to coat the latex barrier timing layer. For example, the addition to the latex before coating of up to 4% by weight of surfactants such as Triton X-100 (believed to be p-octylphenoxypolyethoxyethanol) or solvents such as methyl cellosolve may aid in the coating uniformity of the latex.

Another preferred terpolymer comprising 15 weight percent methyl acrylate, 83 weight percent vinylidene chloride and 2 weight percent itaconic acid is prepared by generally the same method as described above.

Further examples of latex polymers useful herein can be found in U.S. Pat. No. 3,271,345, 2,627,088, 2,491,023, 2,779,684, 3,437,484, 2,943,937 and 3,143,421.

In embodiments where two barrier timing layers are used it is preferred that the timing layers are so arranged that the layer having an activation energy to penetration by aqueous alkaline solution of less than 18 kcal/mole is coated first on the neutralizing acid layer and the layer having an activation energy to penetration by aqueous alkaline solution of greater than 18 kcal/mole is coated directly over the first timing layer. In certain instances, superior interlayer adhesion is obtained when the layers are coated in this order, especially when the acid is coated from organic solvents. The preferred particle size of the polymeric latex is between about 25 and 160 nm. Where two barrier timing layers are used, they can be separated by other layers but, in certain preferred embodiments, are contiguous to each other. In certain instances, materials such as development restrainers, development inhibitors and the like can be put in one or both of the layers to achieve desired results.

Barrier timing layers comprising polymers such as cellulose esters and polyvinyl esters and acetals are coated by conventional methods from solutions in organic solvents such as acetone, methylene chloride and the like. Timing layers comprising mixtures of cellulose acetate and poly(styrene-co-maleic anhydride) are generally employed at coverages of 2–8 g/m$^2$, preferably 2.5–4.5 g/m$^2$.

The latex barrier timing layers can be coated by conventional aqueous coating process. Essential to the proper barrier timing characteristics are the time and temperature of drying of the latex layer. Factors important in the coalescence of polymeric latices are set forth by Vanderhoff and Bradford, "Mechanism of Film Formation of Latices," *TAPPI*, 46, 215–221 (1963).

The latex coatings can be dried over a wide range of temperatures preferably from 55°–95° C. Drying times can be from 30 seconds to 5 minutes, preferably 30 seconds to 2 minutes, the shorter times in general being more appropriate for the higher temperatures and the longer times for the lower temperatures. In general, in order to achieve a given degree of permeability of the at least partially coalesced latex, higher drying temperatures may be required for the latices with the higher acid content in the copolymer. It will be noted that the same polymers can be used for both the alkali permeable adhesion promoting layer and the latex barrier timing layer, the difference being that the barrier timing layer is coalesced while the adhesion promoting layer is substantially uncoalesced. Coalescing the latex is accomplished by using relatively high drying temperatures compared to the drying temperatures used for uncoalesced layers. It is noted that the substrate the layer containing the latex is coated on may affect the degree of coalescence of the layer.

The latex barrier timing layers can generally be employed over a broad range of coverages. Preferred coatings for each layer range from about 1.0 g/m$^2$ to 6.0 g/m$^2$ and more preferably from about 1 to 3 g/m$^2$.

The neutralizing layer employed in this invention which becomes operative after permeation of the processing composition through the timing layers will effect a reduction in the pH of the image layers from about 13 or 14 to at least 11 and preferably 5–8 within a short time after imbibition. For example, polymeric acids as disclosed in U.S. Pat. No. 3,362,819 or solid acids or metallic salts, e.g., zinc acetate, zinc sulfate, magnesium acetate, etc., as disclosed in U.S. Pat. No. 2,584,030 may be employed with good results. Such neutralizing or pH-lowering materials reduce the pH of the film unit after development to terminate development and substantially reduce further dye transfer and thus stabilize the dye image.

In most instances, where the cover sheet is to be laminated with the image generating element for long periods of time before exposure and processing, it is desirable to include a matting agent in its outermost layer. The matting agent reduces "blocking" or sticking of the cover sheet to the image generating element during storage. Thus a matting agent such as methyl methacrylate beads may be included in the coating composition for either the alkaline permeable hydrophilic layer or other outermost alkaline permeable layer.

In one embodiment according to this invention, the film units are integral imaging-receiver color diffusion transfer film units disclosed in Canadian Patent 928,559. In this embodiment, the support for the photosensitive element is transparent and is coated with the image-receiving layer, an opaque light-reflective layer, a black opaque layer and photosensitive layers having associated therewith dye image-providing materials. A rupturable container containing an alkaline processing composition and an opacifier such as carbon black is positioned adjacent the top layer and a transparent cover sheet. The cover sheet comprises a transparent support which is coated with a neutralizing layer, the barrier timing layer or layers and the alkaline permeable hydrophilic layer. The film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the film unit. During the first few seconds after discharge, excess water is absorbed from the processing composition thereby inhibiting bubble coalescence and delamination. The silver halide layers are developed and dye images are formed as a function of development. The dyes diffuse to the image-receiving layer to provide an image which is viewed through the transparent support on the opaque reflecting layer background. The timing layer or layers break down after a period of time and make available materials to neutralize the alkaline processing composition and to shut down further silver halide development. For further details concerning the format of this particular integral film unit, reference is made to the above-mentioned Canadian Patent 928,559, which is incorporated herein by reference.

The photosensitive element useful in this invention can be treated with an alkaline processing composition to effect or initiate development in any manner. A preferred method for applying processing composition is by use of a rupturable container or pod which contains the composition. In general, the processing composition employed in this invention contains the developing agent for development, although the composition could also be just an alkaline solution where the developer is incorporated in the photosensitive element, in which the case the alkaline solution serves to activate the incorporated developer.

The dye image-providing materials which may be employing in this invention generally may be characterized as either (1) initially soluble or diffusible in the processing composition but selectively rendered nondiffusible in an image-wise pattern as a function of development, such as those disclosed, for example, in U.S. Pat. No. 2,647,049, 2,661,293, 2,698,244, 2,698,789, 2,802,735, 2,774,668 and 2,983,606 or (2) initially insoluble or nondiffusible in the processing composition but providing a diffusible image dye-providing material as a function of development, such as those disclosed, for example, in U.S. Pat. Nos. 3,227,550, 3,227,551, 3,227,552, 3,227,554, 3,243,294 and 3,445,228.

These materials may contain preformed dyes or dye precursors, e.g. color couplers, oxichromic compounds and the like.

In a preferred embodiment of this invention, the dye image-providing material is a ballasted redox dye releaser. Such compounds are, generally speaking, compounds which can be oxidized, i.e. crossoxidized, by an oxidized developing agent to provide a species which as a function of oxidation will release a diffusible dye, such as by alkaline hydrolysis. Such redox dye releasers are described in U.S. Pat. Nos. 3,725,062 of Anderson and Lum issued Apr. 3, 1973, 3,698,897 of Gompf and Lum issued Oct. 17, 1973, 3,628,952 of Puschel et al issued Dec. 21, 1971, and 3,443,939 of Bloom et al and 3,443,940 of Bloom et al, both issued May 13, 1969, and the following copending applications: Serial Nos. B351,673 of Fleckenstein et al, published Jan. 28, 1975 now U.S. Pat. No. 4,076,529 and 351,700 of Fleckenstein, now U.S. Pat. No. 3,928,312 both filed Apr. 16, 1973; 331,727 and 331,729 of Landholm et al, both filed Feb. 12, 1973; 331,728 of Haase et al, filed Feb. 12, 1973, the disclosures of which are hereby incorporated by reference.

The term "nondiffusible" as used throughout the specification is intended to mean that the material will not substantially diffuse either within or from the layer in which it is located within the photographic element during contact in an alkaline solution at a pH, for example, of greater than 11. In most cases, the material is ballasted so as to render it nondiffusible. Likewise, the term "diffusible" is intended to mean that the material when in contact with alkaline solution under conditions similar to those described above will substantially migrate from its layer in the photographic element to the image-receiving layer where it is mordanted.

In one preferred embodiment of this invention, the redox dye releasers in the Fleckenstein et al, U.S. published application Ser. No. B351,973 referred to above are employed. Such compounds are nondiffusible sulfonamido compounds which are alkali-cleavable upon oxidation to release a diffusible sulfonamido dye. In certain preferred embodiments, the compounds have the formula:

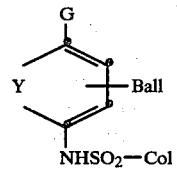

wherein:

(1) Ball represents an organic ballasting group (preferably containing at least 8 carbon atoms) which renders said compound nondiffusible in a photographic element during processing of said element with an alkaline composition;

(2) Y represents the carbon atoms necessary to complete a carrier moiety;

(3) G is OR or $NHR_1$ wherein R is hydrogen or a hydrolyzable moiety and $R_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc. (when $R_1$ is an alkyl group of greater than 6 carbon atoms, it can serve as a partial or sole Ballast group); and (4) Col is a dye or dye precursor moiety.

For further details concerning the above-described sulfonamido compounds and specific examples of same, reference is made to the above-mentioned Fleckenstein et al application Ser. No. B351,673, Belgian Pat. No. 799,268 issued Feb. 28, 1972, and *Research Disclosure* 15157 published Nov. 11, 1976, the disclosures of which are hereby incorporated by reference.

In another preferred embodiment of the invention, initially diffusible dye image-providing materials are employed such as dye developers, including metal-complexed dye developers such as those described in U.S. Pat. Nos. 3,453,107, 3,554,545, 3,551,406, 3,563,739, 3,597,200 and 3,705,184 and oxichromic developers as described and claimed in U.S. Pat. No. 3,880,658 by my coworkers Lestina and Bush issued Apr. 29, 1975, the disclosures of which are hereby incorporated by reference. When oxichromic developers are employed, the image is formed by the diffusion of the oxichromic developer to the dye image-receiving layer where it undergoes chromogenic oxidation to form an image dye.

The film unit of the present invention may be used to produce positive images in single- or multicolors, as well as in black and white. In a three-color system, each silver halide emulsion layer of the film assembly will have associated therewith a dye image-providing material capable of providing a dye having a predominant spectral absorption within the region of the visible spectrum to which said silver halide emulsion is sensitive, i.e. the blue-sensitive silver halide emulsion layer will have yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous the silver halide emulsion layer.

The concentration of the dye image-providing materials that are employed in the present invention may be varied over a wide range depending upon the particular compound employed and the results which are desired. For example, the dye image-providing compounds may be coated as dispersions in layers by using coating compositions containing a weight ratio between about 0.25 and about 4 of the dye image-providing compound to the hydrophilic film-forming natural material or synthetic polymer binder, such as gelatin, polyvinyl alcohol, etc., which is adapted to be permeated by aqueous alkaline processing composition.

Generally, most silver halide developing agents can be employed to develop the silver halide emulsions in the photographic elements of this invention. The developer may be employed in the photosensitive element to be activated by the alkaline processing composition. Specific examples of developers which can be employed in this invention include:

hydroquinone
N-methylaminophenol
Phenidone (1-phenyl-3-pyrazolidinone)
Dimezone (1-phenyl-4,4-dimethyl-3-pyrazolidinone)
aminophenols
N-N-diethyl p-phenylenediamine
3-methyl-N,N-diethyl-p-phenylendiamine
N,N,N',N'-tetramethyl-p-phenylenediamine
4-hydroxymethyl-4-methyl-1phenyl-3-pyrazolidinone
etc.

In using redox dye releaser compounds in this invention, diffusible dye images are produced as a function of development of the silver halide emulsions. If the silver halide emulsion employed forms a direct-positive silver image, such as a direct-reversal internal-image emulsion or a solarizing emulsion, which is developable in unexposed areas, a positive image can be obtained on the dye image-receiving layer when redox releasers are employed which release dye where oxidized. After exposure of the film unit, the alkaline processing composition permeates the various layers to initiate development in the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then crossoxidizes the redox dye releaser compound, the oxidized form of which either releases directly or undergoes a base-catalyzed reaction to release the preformed dyes or the dye precursors imagewise as a function of the imagewise exposure of each of the silver halide emulsion layers. At least a portion of the imagewise distributions of diffusible dyes or dye precursors diffuses to the image-receiving layer to form a positive image of the original subject.

Internal-image silver halide emulsions useful in the above-described embodiment are direct-positive emulsions that form latent images predominantly inside the silver halide grains, as distinguished from silver halide grains that form latent images predominantly on the surface thereof. Such internal-image emulsions were described by Davey et al in U.S. Pat. No. 2,592,250 issued Apr. 8, 1952, and elsewhere in the literature. Other useful emulsions are described in U.S. Pat. Nos. 3,761,276, 3,761,266 and 3,761,267, all issued Sept. 25, 1973. Internal-image silver halide emulsions can be defined in terms of the increased maximum density obtained when developed to a negative silver image with "internal-type" developers over that obtained when developed with "surface-type" developers. Suitable internal-image emulsions are those which, when measured according to normal photographic techniques by coating a test portion of the silver halide emulsion on a transparent support, exposing to a light-intensity scale having a fixed time between 0.01 and 1 second, and developing for 3 minutes at 20° C. in Developer A below ("internal-type" developer), have a maximum density at least 5 times the maximum density obtained when an equally exposed silver halide emulsion is developed for 4 minutes at 20° C. in Developer B described below ("surface-type" developer). Preferably, the maximum density in Developer A is at least 0.5 density unit greater than the maximum density in Developer B.

| Developer A | |
|---|---|
| hydroquinone | 15 g |
| monomethyl-p-aminophenol sulfate | 15 g |
| sodium sulfite (desiccated) 50 g | |
| potassium bromide | 10 g |
| sodium hydroxide | 25 g |
| sodium thiosulfate | 20 g |
| water to make one liter | |
| **Developer B** | |
| p-hydroxyphenylglycine | 10 g |
| sodium carbonate | 100 g |
| water to make one liter | |

The internal-image silver halide emulsions when processed in the presence of fogging or nucleating agents provide direct-positive silver images. Such emulsions are particularly useful in the above-described embodiment. Suitable fogging agents include the hydrazines disclosed by Ives, U.S. Pat. Nos. 2,588,982 issued Mar. 11, 1952 and 2,563,785 issued Aug. 7, 1951; the hydrazides and hydrazones disclosed by Whitmore, U.S. Pat. No. 3,227,552 issued Jan. 4, 1966; hydrazone quaternary salts described in British Pat. No. 1,283,835 and U.S. Pat. No. 3,615,615; hydrazone-containing polymethine dyes described in U.S. Pat. No. 3,718,470; and the fogging agents disclosed in copending application Ser. Nos. 601,891 and 601,888 of Leone et al, filed Aug. 6, 1975, or mixtures thereof. The quantity of fogging agent employed can be widely varied depending upon the results desired. Generally, the concentration of fogging agent is from about 0.4 to about 8 g per mole of silver in the photosensitive layer in the photosensitive element or from about 0.1 to about 2 g per liter of developer if it is located in the developer. The fogging agents described in U.S. Pat. Nos. 3,615,615 and 3,718,470, however, are preferably used in concentrations of 50 to 400 mg per mole of silver in the photosensitive layer.

Typical useful direct-positive emulsions are disclosed in U.S. Pat. Nos. 3,227,552 by Whitmore issued Jan. 4, 1966, 3,761,276 by Evans issued Sept. 25, 1973, 3,761,267 by Gilman et al, 3,761,266 by Milton, 3,703,584 by Motter and the like.

In other embodiments, the direct-positive emulsions can be emulsions which have been fogged either chemically or by radiation on the surface of the silver halide grains to provide for development to maximum density without exposure. Upon exposure, the exposed areas do not develop, thus providing for image discrimination and a positive image. Silver halide emulsions of this type are very well-known in the art and are disclosed, for example, in U.S. Pat. No. 3,367,778 by Berriman issued Feb. 6, 1968 and 3,501,305, 3,501,306 and 3,501,307 by Illingsworth, all issued Mar. 17, 1970.

In still other embodiments, the direct-positive emulsions can be of the type described by Mees and James, *The Theory of the Photographic Process,* published by MacMillan Company, New York, New York, 1966, pp. 149–167.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layer for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention can be of the type disclosed in U.S. Pat. Nos. 2,543,181, 2,643,886, 2,653,732, 2,723,051, 3,056,492, 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

In a color photographic film unit according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104, 3,043,692, 3,044,873, 3,061,428, 3,069,263, 3,069,264, 3,121,011 and 3,427,158.

Generally speaking, except where noted otherwise, the silver halide emulsion layers in the invention comprise photosensitive silver halide dispersed in gelatin and are about 0.25 to 5 microns in thickness; the dye image-providing materials are dispersed in an aqueous alkaline solution-permeable polymeric binder, such as gelatin, as a separate layer about 0.25 to 5 microns in thickness; and the alkaline solution-permeable polymeric interlayers, e.g. gelatin, are about 0.25 to 5 microns in thickness. Of course, these thicknesses are approximate only and can be modified according to the product desired.

The alkaline solution-permeable, light-reflective layer employed in certain embodiments of photographic film units of this invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix, such as, for example gelatin, polyvinyl alcohol and the like. Brightening agents such as the stilbenes, coumarins, triazines and oxazoles can also be added to the light-reflective layer if desired. When it is desired to increase the opacifying capacity of the light-reflective layers, dark-colored opacifying agents, e.g., pH-indicator dyes may be added to it, or carbon black, nigrosine dyes, etc. may be coated in a separate layer adjacent the light-reflective layer.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymeric mordants such as polymers of amino guanidine derivatives of vinyl methyl ketone such as described by Minsk, U.S. Pat. No. 2,882,156 issued Apr. 14, 1959, and basic polymeric mordants such as described in U.S. Pat. No. 3,709,690, 3,625,694, 3,898,088 by Cohen et al issued Aug. 5, 1975 and 3,859,096 by Burness et al issued Jan. 7, 1975. Other mordants useful in this invention include poly-4-vinylpyridine, the 2-vinylpyridine polymer metho-p-toluene sulfonate and similar compounds described by Sprague et al, U.S. Pat. No. 2,484,430 issued Oct. 1, 1949 and cetyl trimethylammonium bromide, etc. Effective mordanting compositions are also described in U.S. Pat. Nos. 3,271,148 by Whitmore and 3,271,147 by Bush, both issued Sept. 6, 1966 and in U.S. Pat. No. 3,958,995 by Campbell et al, issued May 25, 1976.

Other materials useful in the dye image-receiving layer include alkaline solution-permeable polymeric layers such as N-methoxymethyl polyhexamethylene adipamide, partially hydrolyzed polyvinyl acetate and other materials of a similar nature. Generally, good results are obtained when the image-receiving layer, preferably alkaline solution-permeable, is transparent and about 0.25 to about 5$\mu$ in thickness. This thickness, of course, can be modified depending upon the result desired. The image-receiving layer can also contain ultraviolet absorbing materials, to protect the mordanted dye images from fading due to ultraviolet light, and brightening agents such as the stilbenes, coumarins, triazines, oxazoles, dye stabilizers such as the chromanols, alkylphenols, etc.

The alkaline processing composition employed in this invention is the conventional aqueous solution of an alkaline material, e.g. sodium hydroxide, sodium carbonate or an amine such as diethylamine, preferably processing a pH in excess of 11, and preferably containing a developing agent as described previously. The solution also preferably contains a viscosity-increasing compound such as a high-molecular-weight polymer, e.g., a water-soluble ether inert to alkaline solutions such as hydroxyethyl cellulose or alkali metal salts of carboxymethyl cellulose such as sodium carboxymethyl cellulose. A concentration of viscosity-increasing compound of about 1 to about 5% by weight of the processing composition is preferred which will impart thereto a viscosity of about 100 cps to about 200,000 cps. In certain embodiments of this invention, an opacifying agent, e.g. $TiO_2$, carbon black, indicator dyes, etc. may be added to the processing composition. In addition, ballasted indicator dyes and dye precursors may also be present in the photographic film unit as a separate layer on the exposure side of the photosensitive layers, the indicator dyes being preferably transparent during exposure and becoming colored or opaque after contact with alkali from the processing composition.

The support for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethyleneterephthalate) film, polycarbonate film, poly-$\alpha$-olefins such as polyethylene and polypropylene film and related films or resinous materials. The support is usually about 2 to 9 mils (50–225 $\mu$m) in thickness. Ultraviolet-absorbing materials may also be included on the supports or as a separate layer on the supports if desired.

The silver halide emulsions useful in this invention are well-known to those skilled in the art and are described in *Product Licensing Index,* Vol. 92, December, 1971, publication 9232, p. 107, paragraph I, "Emulsion types." They may be chemically and spectrally sensitized as described on p. 107, paragraph III, "Chemical sensitization" and pp. 108–109, paragraph XV, "Spectral sensitization" of the above article; they can be protected against the production of fog and can be stabilized against loss of sensitivity during keeping by employing the materials described on p. 107, paragraph V, "Antifoggants and stabilizers" of the above article; they can contain development modifiers, hardeners and coating aids as described on pp. 107–108, paragraph IV, "Development modifiers"; paragraph VII, "Hardeners"; and paragraph XII, "Coating aids" of the above article; they and other layers in the photographic elements used in this invention can contain plasticizers, vehicles and filter dyes described on p. 108, paragraph XI, "Plastizers and lubricants," and paragraph VIII, "Vehicles" and p. 109, paragraph XVI, "Absorbing and filter dyes" of the above article; they and other layers in the photographic elements used in this invention may contain addenda which are incorporated by using the procedures described on p. 109, paragraph XVII, "Methods of addition" of the above article; and they can be coated using the various techniques described on p. 109, paragraph XVIII, "Coating procedures" of the above article; the disclosures of which are hereby incorporated by reference.

The following examples further illustrate the invention.

EXAMPLE 1

The effect of an alkaline permeable hydrophilic layer on the formation of coalesced bubbles and delamination was demonstrated by comparing two sets of samples of image transfer film units. The first set of samples, designated group A, was a control set. The cover sheets for these samples had a support coated with three layers, in the order indicated:

(1) an acid layer comprising 15.5 g/m$^2$ of poly(n-butylacrylate-co-acrylic acid) (70 weight percent acrylic acid); and (2) a timing layer comprising 5-(2-cyanoethylthio)-1-phenyltetrazole (0.11 g/m$^2$). cellulose acetate (40% acetyl) (4.31 g/m$^2$) and poly(styrene-co-maleic anhydride) (0.11 g/m$^2$); and (3) poly(acrylonitrile-co-vinylidene chloride-co-acrylic acid) (2.15 g/m$^2$) dried at 88° C. for 2 minutes.

The cover sheets for the second set of samples, group B, had the same three layers as group A and an additional layer coated over the original three as follows:

(4) an alkali permeable hydrophilic layer comprising gelatin (3.8 g/m$^2$) and bis(vinyl sulfonylmethyl) ether (38 mg/m$^2$); and In addition, the top layer of both group A and group B (layers 3 and 4 respectively) contained 43 mg/m$^2$ of methyl methacrylate beads as a matting agent.

The cover sheets were used to process a multicolor integral-imaging-receiver element prepared by coating the following layers in the order recited on a transparent poly(ethylene terephthalate) film support (coverages in g/m$^2$ unless specified otherwise):

(1) image-receiving layer of a latex of copoly-[styrene-co-N-vinylbenzyl-N-benzyl-N,N-dimethylammonium sulfate-co-divinylbenzene] (2.2) and gelatin (2.2);

(2) reflecting layer of titanium dioxide (22) and gelatin (2.2);

(3) opaque layer of carbon black (2.7) and gelatin (1.7);

(4) cyan image dye-providing compound (0.54) having the formula:

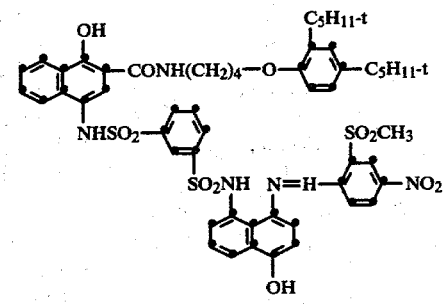

dispersed in 1,4-cyclohexylenedimethylene bis(2-ethyl hexanoate) and gelatin (1.1);

(5) red-sensitive, internal-image gelatin-silver bromide emulsion (1.1 silver; 1.1 gelatin), potassium 2-octadecylhydroquinone-5-sulfonate (16 g/mole silver) and nucleating agents 1-acetyl-2-{4-[5-amino-2-(2,4-di-t-pentylphenoxy)benzamido]-phenyl}-hydrazine and 1-p-formylhydrazinophenyl-3-phenyl-2-thiourea (150 mg and 6 mg/mole silver, respectively);

(6) interlayer of gelatin (1.6) and 2,5-di-sec-dodecylhydroquinone (1.3);

(7) magenta image dye-providing compound (0.54) having the formula:

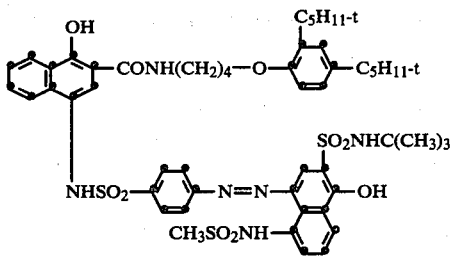

dispersed in diethyllauramide and gelatin (1.2);

(8) green-sensitive, internal-image gelatin-silver bromide emulsion (1.25 silver, 1.3 gelatin), potassium 2-octadecylhydroquinone-5-sulfonate (16 g/mole silver) and nucleating agents 1-acetyl-2-{4-[5-amino-2-(2,4-di-t-pentylphenoxy)benzamido]-phenyl}-hydrazine and 1-formylhydraqinophenyl-3-phenyl-2-thiourea (120 mg and 2.5 mg/mole silver, respectively);

(9) interlayer of gelatin (1.6) and 2,5-di-secdodecylhydroquinone (1.3);

(10) yellow image dye-providing compound (0.65) having the formula:

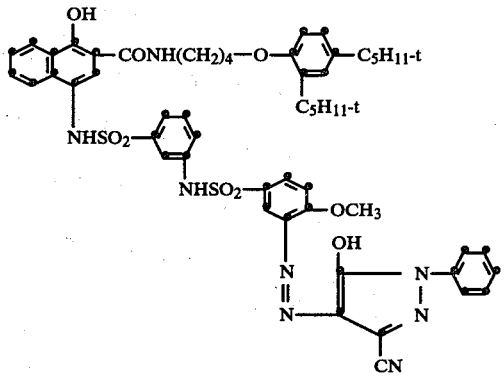

dispersed in 1,4-cyclohexylenedimethylene bis(2-ethyl hexanoate) and gelatin (1.1);

(11) blue-sensitive, internal-image gelatino-silver bromide emulsion (1.25 silver, 1.3 gelatin), potassium 2-octadecylhydroquinone-2-sulfonate (16 g/mole silver) and nucleating agent 1-p-formylhydrazinophenyl-3-phenyl-2-thiourea (5.8 mg/mole silver); and

(12) overcoat of gelatin (0.9) and 2,5-didodecylhydroquinone (0.11).

The following processing composition was employed in a frangible pod which is positioned between the cover sheet and the integral imaging receiver described above:

| | |
|---|---|
| potassium hydroxide | 47.0 g |
| sodium hydroxide | 3.4 g |
| methylhydroquinone | 0.1 g |
| t-butylhydroquinone | 0.3 g |
| 4-hydroxymethyl-4-methyl-1-phenyl pyrazolidone | 12.0 g |
| 5-methyl-1,2,3-benzotriazole | 3.8 g |
| carboxymethylcellulose | 66.8 g |
| dispersant | 8.8 g |
| sodium sulfite (anhydrous) | 1.0 g |
| benzyl alcohol | 1.0 g |
| carbon | 171.0 g |

-continued

| |
|---|
| distilled water to total volume 1 liter |

Samples of film units from group A and group B were uniformly exposed in a camera so that the entire picture area would develop only to the minimum density. The film units were passed after exposure between a pair of juxtaposed pressure rollers in the camera to break the frangible pod and discharge the alkaline processing composition between the cover sheet and the integral imaging receiver.

RESULTS

The picture portion of each sample developed to a uniform faint gray. Along the aperture borders of samples from the control group A, numerous black spots formed. The black spots are attributable to the fogging of the integral imaging receiver during processing because of discontinuities in the processing composition caused by coalesced bubbles. Also apparent in group A samples were numerous black finger like projections extending from the borders as much as 2 mm into the picture area. This imperfection is caused by delamination of the cover sheet from the integral imaging receiver which again causes discontinuities in the processing composition and fogging of the film units. In contrast, processed film units from group B showed little or no black spots from coalesced bubbles and little or no delamination imperfections.

EXAMPLE 2

Example 1 was repeated except that the film units from group B were replaced with film units having a cover sheet having, in addition to the four layers described for the cover sheet of group B, a fifth layer. The fifth layer was coated on the alkali permeable hydrophilic layer and was an alkali permeable, adhesion promoting layer comprising poly(acrylonitrile-co-vinylidene chloride-co-acrylic acid) (1.1 g/m$^2$) which was dried at 38° C. for 2 minutes. This layer also had the matting agent as in Example 1. Like the film units of group B, these film units showed little or no black spots from coalesced bubbles and little or no delamination imperfections.

EXAMPLE 3

Three film units were prepared which were like the film units from group B of Example 1 except that layer (4) of the cover sheet was varied as follows:

EXAMPLE 3A a gelatin layer as in Example 1 except that the coverage was 4.3 g/m$^2$.

EXAMPLE 3B a layer of poly(vinyl alcohol), Elvanol® 71-30 coated at a coverage of 4.3 g/m$^2$.

Prior Art a layer containing a 2:1 mixture of poly(vinyl alcohol) Elvanol® 71-30 and poly(4-vinylpyridine) coated at a total coverage of 4.3 g/m$^2$ as described in U.S. Pat. No. 3,836,365.

The film units were exposed to a graduated multicolor test object and then processed as in Example 1. Sensitometric curves were read from the image receiving layer of the integral imaging receiver by reflection densitometry about 3 hours after processing. The results are tabulated below:

| Cover Sheet | Dmax B | Dmax G | Dmax R | Dmin B | Dmin G | Dmin R |
|---|---|---|---|---|---|---|
| Example 3A | 1.91 | 1.90 | 1.99 | 0.19 | 0.19 | 0.24 |
| Example 3B | 1.89 | 1.91 | 1.98 | 0.18 | 0.19 | 0.24 |
| Prior Art | 1.46 | 1.51 | 1.91 | 0.18 | 0.18 | 0.22 |
| Dmax loss Example 3B to Prior Art | −0.43 | −0.40 | −0.07 | | | |

The film units having either the gelatin layer or the poly(vinyl alcohol) layer as the alkali permeable hydrophilic layer in the cover sheet produced similar sensitometry when exposed and processed. The use of an alkali permeable hydrophilic layer with a substantial amount of dye mordant, i.e. as in the cover sheet indicated by Prior Art, resulted in a severe loss in blue and green Dmax.

The invention has been described in detail with particular reference to certain preferred embodiments thereof, but it will be understood that variations and modifications can be effected within the spirit and scope of the invention.

What is claimed is:

1. In a photographic film unit comprising:
(a) an integral imaging receiver element comprising a support having thereon at least one photosensitive silver halide emulsion layer having associated therewith a dye image providing material and a dye image receiving layer containing a dye mordant; and having adjacent to said intergral imaging receiver element;
(b) a cover sheet comprising, in order, starting with the layer adjacent to said integral imaging receiver element, a barrier timing layer, a neutralizing layer for neutralizing an alkaline processing composition and a support; and
(c) an aqueous alkaline processing composition and means for discharging same between said integral imaging receiver element and said cover sheet;
the improvement comprising an alkali permeable hydrophilic layer which is substantially free of dye mordant coated over said barrier timing layer on said cover sheet so as to be between said barrier timing layer and said integral imaging receiver element.

2. The photographic film unit of claim 1 wherein said alkali permeable hydrophilic layer comprises a material selected from the group consisting of gelatin, poly(vinyl alcohol), poly(ethyl methacrylate-co-methacrylic acid), poly(methyl methacrylate-co-methacrylic acid), poly(-methyl vinyl ether-co-maleic anhydride), casein, carboxymethyl cellulose, cellulose phthalate and hydroxyethylcellulose and grafted starch copolymers.

3. The photographic film unit of claim 1 further comprising an alkali permeable adhesion promoting layer coated on said hydrophilic layer, said adhesion promoting layer being adjacent to said integral imaging receiver element.

4. The photographic film unit of claim 3 wherein said adhesion-promoting layer further comprises a matting agent.

5. The photographic film unit of claim 1 wherein said alkali permeable hydrophilic layer is the outermost layer of said cover sheet and wherein said alkali-permeable hydrophilic layer further comprises a matting agent.

6. The photographic film unit of either claim 5 or 4 wherein said matting agent comprises methyl methacrylate beads.

7. The photographic film unit of claim 1 wherein said barrier timing layer has an activation energy of penetration of the layer by aqueous alkaline solution of greater than 18 kcal/mole and comprises polymer latex comprising a terpolymer of from about 5 to about 35 percent by weight of polymerized ethylenically unsaturated monomer from about 2 to about 10 percent by weight of a polymerized unsaturated carboxylic acid and from about 55 to about 85 percent by weight of polymerized vinylidene chloride.

8. The photographic film unit of claim 1 wherein said alkali permeable hydrophilic layer comprises gelatin.

9. The photographic film unit of claim 8 wherein said gelatin alkali permeable hydrophilic layer is coated at a coverage of from 3 to 4 grams per square meter of cover sheet.

10. The photographic film unit of claim 9 wherein said gelatin alkali permeable hydrophilic layer further comprises 0.5 to 2.0 weight percent of hardener.

11. The photographic film unit of claim 1 wherein said alkali permeable hydrophilic layer is coated at a coverage of from 2 to 5.5 grams per square meter of cover sheet.

12. The photographic film unit of claim 10 wherein said hardener is bis(vinylsulfonylmethyl) ether present at about 1.0 weight percent.

13. The photographic film unit of claim 1 having a first and a second barrier timing layer wherein said first layer is adjacent to said neutralizing layer and comprises a polymer and has an activation energy of penetration of the layer by an aqueous alkaline solution of less than 18 kcal/mole and wherein said second layer is coated over said first layer and comprises a polymer latex and has an activation energy of penetration of the layer by aqueous alkaline solution of greater than 18 kcal/mole and comprises a terpolymer of from about 5 to about 35 percent by weight of polymerized ethylenically unsaturated monomer from about 2 to about 10 percent by weight of a polymerized unsaturated carboxylic acid and from about 55 to about 85 percent by weight of polymerized vinylidene chloride.

14. The photographic film unit of claim 13 wherein said first barrier timing layer comprises a mixture of cellulose acetate and a maleic anhydride copolymer, said mixture comprising about 5 to about 50 percent by weight of said copolymer.

15. The photographic film unit of claim 13 wherein said second barrier layer comprises from about 5 to about 35 percent by weight of acrylonitrile, from about 4 to about 10 percent by weight of an ethylenically unsaturated carboxylic acid selected from the group consisting of acrylic acid and itaconic acid, and from about 55 to about 85 percent by weight of vinylidene chloride.

16. The photographic film unit of claim 1 wherein
(a) said support for said integral image receiving element is transparent;
(b) said dye image receiving layer is adjacent to said transparent support and separated from said silver halide emulsion layer by an alkaline solution permeable reflective opaque layer;
(c) said support for said cover sheet is transparent; and (d) said discharging means is a rupturable container containing said alkaline processing composition and an opacifying agent.

17. The film unit of claim 1 wherein (a) said integral imaging receiver element comprises a transparent support having thereon, in order, an image-receiving layer; an alkaline solution-permeable, light-reflective layer; an alkaline solution-permeable opaque layer, a red-sensitive silver halide emulsion layer having a ballasted redox cyan dye releaser associated therewith; a green-sensitive silver halide emulsion layer having a ballasted redox magenta dye releaser associated therewith; and a blue-sensitive silver halide emulsion layer having a ballasted redox yellow dye releaser associated therewith;

(b) said cover sheet comprises, in order, an alkali permeable adhesion promoting layer; an alkali permeable hydrophilic layer which is substantially free of dye mordant coated at a coverage of between 2 and 5.5 grams per square meter of cover sheet; a barrier layer which comprises a polymeric latex and has an activation energy of penetration of the layer by an aqueous alkaline solution of greater than 18 kcal/mole and comprises a terpolymer of from about 5 to about 35 percent by weight of polymerized ethylenically unsaturated monomer from about 2 to about 10 percent by weight of a polymerized unsaturated carboxylic acid and from about 55 to about 85 percent by weight of polymerized vinylidene chloride; a polymeric barrier timing layer having an activation energy of penetration of the layer by an aqueous alkaline solution of less than 18 kcal/mole; a neutralizing layer for neutralizing an aqueous alkaline processing composition; and a transparent support.

18. The film unit of claim 17 wherein each said redox dye releaser is a nondiffusible sulfonamido compound which is alkali-cleavable upon oxidation to release a diffusible colorproviding moiety from the benzene nucleus, said compound having the formula:

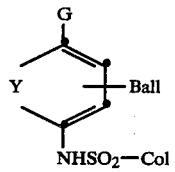

wherein:

(a) col is a dye or dye precursor moiety;

(b) Ball is an organic ballasting group which renders said compound nondiffusible in a photographic element during development in an alkaline processing composition having a pH of at least 11;

(c) Y represents the carbon atoms necessary to complete a carrier moiety; and (d) G is OR or $NHR_1$ wherein R is hydrogen or a hydrolyzable moiety and $R_1$ is hydrogen or an alkyl group of 1 to 22 carbon atoms.

* * * * *